United States Patent [19]

Heidinger et al.

[11] Patent Number: 4,681,676

[45] Date of Patent: Jul. 21, 1987

[54] ANALYTIC SIEVING APPARATUS

[75] Inventors: Alfred J. Heidinger, Chester; Robert W. Duyckinck, New Providence, both of N.J.

[73] Assignee: Mikropul Corporation, Summit, N.J.

[21] Appl. No.: 716,987

[22] Filed: Mar. 28, 1985

[51] Int. Cl.[4] ..... B07B 1/55

[52] U.S. Cl. ..... 209/380; 209/358; 406/89; 366/101; 222/195

[58] Field of Search ..... 209/21, 22, 28, 29, 209/44.2, 132, 133, 138, 139 R, 233, 240, 245, 250, 352, 358, 379, 380, 906; 406/96, 99, 88, 89; 55/8; 366/101, 102, 103; 222/195

[56] References Cited

U.S. PATENT DOCUMENTS

| | | | |
|---|---|---|---|
| 658,948 | 10/1900 | Gregg | 366/102 X |
| 1,661,299 | 3/1928 | Peron | 209/29 |
| 2,753,996 | 7/1956 | Kaiser | 209/139.1 |
| 2,833,412 | 5/1958 | Ahlmann | 209/380 X |
| 2,892,286 | 6/1959 | Martin | 222/195 X |

FOREIGN PATENT DOCUMENTS

| | | | |
|---|---|---|---|
| 1126224 | 3/1962 | Fed. Rep. of Germany | 209/379 |
| 297404 | 4/1971 | U.S.S.R. | 209/380 |

*Primary Examiner*—Robert B. Reeves
*Assistant Examiner*—Glenn B. Foster

[57] ABSTRACT

Improved sieving apparatus for size analysis of dry powder having a sample chamber floored by a sieving screen and an underlying fines chamber adapted to be mated in fluid communication therewith. Disposed beneath the screen is a jet emitting rotor of selective configuration adapted to emit an upwardly directed air jet curtain to repeatedly sweep the underside of the screen to both improve the screening action and to reduce the required time therefore.

3 Claims, 8 Drawing Figures

ANALYTIC SIEVING APPARATUS

This invention relates to dry powder separation by sieving and more particularly to an improved construction for an analytic dry powder sieving device.

BACKGROUND OF THE INVENTION

In the field of particle comminution, dry powder analytical sieving devices provide useful quality control functions. Such devices are commonly used to determine how much of a given comminuted sample taken from a production stream has been reduced to a predetermined size sufficiently fine to enable said fine particles to be sifted through a screen having holes of a predetermined size.

The time required to make such an analytic determination is generally of some significance, not only from the standpoint of the time spent by the person performing the analysis but, more importantly, because production of the product is usually continued while a production sample is being analyzed. Hence, analysis time is of appreciable practical significance, since the longer the analysis time the greater are the amounts of possible off-specification material being produced.

Presently available analytical sieving devices generally comprise a pair of cylindrical chambers stacked one atop the other on a common axis and separated by a sieving screen. A preweighed product sample is deposited onto the screen in the upper chamber and the chamber is then closed. Disposed within the lower chamber is a slotted rotor adapted to direct a jet curtain of air onto the underside of the screen. The upwardly directed air jet curtain emanates from a radially disposed slot on the upper rotor surface that extends generally from the center of the screen outwardly to its periphery. Upon rotation of such air jet rotor, the jet curtain effectively sweeps the entire undersurface of the screen during each 360° revolution thereof. A vacuum vent in the lower chamber functions to permit withdrawal of the fine particles which pass through the screen under the action of an induced air flow supplemented by gravity and by the agitation of the powder sample by the upward passage of the jet curtain through the screen. The present invention comprises an improved construction for analytic sieving apparatus and for the air jet rotor assembly employed therein. In its broader aspects, the subject invention includes an improved jet rotor assembly configured to emit a selectively shaped air jet curtain of diametric extant across the entire sieve surface in association with a dependent skirt that conjointly functions to sweep the fines that have passed through the screen toward an exhaust channel. In its narrower aspects, such rotor assembly includes a diametric slot that is of linear character adjacent the axis of rotor rotation and which assumes a selectively oriented curved configuration as it approaches the circumference of the sieving screen. In general, when viewed in plan, the slot in the rotor from which the air jet curtain is emitted is of generally bowshaped configuration not unlike a portion of the letter "C".

Among the advantages attendant such improved jet rotor construction and slot configuration is an increase in the ratio of the area of the slot in proportion to the total area of the annulus that is swept by the curved portions of the slot in the vicinity of the screen periphery to provide for increased jet energy at such location and to thus reduce the tendency of particles to accumulate on the screen periphery. The new slot configuration also air washes the sample twice per rotor revolution and its unique shape causes the sample powder on the upper screen surface to be displaced upwardly and then inwardly toward the center of the screen as one curved slot passes beneath the powder and then upwardly and outwardly as the second slot advances therepast, thus effecting a radially oriented reciprocatory displacement of the powder on the screen surface. Such powder displacement appears to significantly increase both the rate of particle displacement and particle scatter thereby releasing more of the fine particles to be sieved for passage through the screen openings. All of the foregoing appear to result in reduced sieving times, for example, by as much as 15% on difficult to sieve powders at least when analyzing specimens on sieves with openings of 45 microns and finer.

In its preferred form, the improved sieving apparatus is adapted to be mounted atop and in fluid communication with a filter assembly designed to access the outward flow of fines after passage through the screen. A flat filter element within said filter assembly provides for collection of fines for weighing, further analysis or preservation or recycling of valuable materials.

A primary object of this invention is an improved analytic sieving device.

Another object of this invention is the provision of an improved sieving device characterized by improved efficiency and reduced analysis time.

More specific objects are to provide an improved rotor construction and air jet slot configuration for an analytic sieving device that functions to air wash the sample screen twice for every revolution of the rotor and which displaces the screen supported particulates in a reciprocatory pattern; and which selectively increases available air wash energy adjacent the screen circumferance to reduce particle accumulation thereat.

A further object of this invention is to provide an improved sieving device that reduces sieving time by up to 15% on "difficult to sieve" powders on sieves with openings of 45 microns and finer. Another object is to provide for convenient retrieval of fines in an analytic sieving device of compact size and modular layout. Other objects and advantages of the subject invention will become apparent from the following portions of this specification and from the appended drawings which illustrate, in accord with the mandate of the patent statutes, a presently preferred embodiment of an analytic sieving device that incorporates the principles of this invention.

Referring to the drawings:

FIG. 2 is a front elevation of the apparatus of the subject invention as mounted on a movable cabinet for use in a laboratory or the like.

Figure 1:
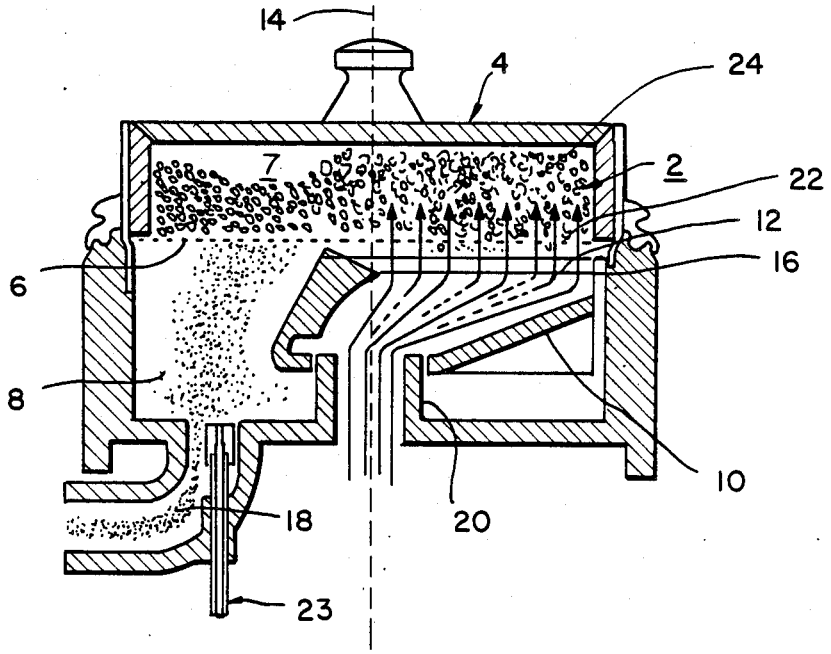
FIG. 1 PRIOR ART
FIG. 1 is a vertical section as taken through an analytic sieving device representative of prior art construction thereof.

Turning now to the drawings, FIG. 1 is generally illustrative of the essential structure of an analytic sieving device of the prior art. Such device generally includes a cylindrical sample chamber, generally designated 2, bounded on its top by a cover 4 and on its underside by a sieving screen 6.

A coaxially aligned cylindrical fines chamber 8 of similar transverse dimension is mated to the bottom of the sample chamber 2 and is disposed in fluid communication therewith through the screen 6. Radially oriented, hollow bladelike rotor 10 sized to extend from the axis of rotation to the periphery of the screen 6 and having its upper surface disposed closely adjacent thereto, is disposed within fines chamber 8 and adapted to be rotatively displaced therewithin. The upper surface of the rotor 10 includes a narrow slot 12 which extends radially outward from the axis of rotation 14 to the circumference 16 of the sieving screen 6 and through which an upwardly directed jet curtain of air is emitted.

The fines chamber 8 includes an outlet 18 connected to a vacuum source (not shown) and to a downstream fines collection area.

The rotor 10 includes a hub portion which encircles an upwardly directed circular sleeve 20 in the housing and through which outside air enters the hollow rotor 10 under impetus of a suitable pressure differential. Such air exits from the hollow rotor 10 through the slot 12 as a jet curtain of air 22 directed to the underside of the screen 6. As the rotor 10 is rotated, the radial air jet curtain 22 sweeps the screen 6 once each revolution to clean the screen openings and to agitate the sample powder 24 on the screen upper surface.

The fine powder particles are thus freed to more readily flow through the recently cleared sieve openings in association with the induced air flow passage through the screen 6, into the fines chamber 8 and out through outlet 18 for subsequent collection. A manometer 23 can be employed to monitor air pressure at the outlet 18.

Figure 2:
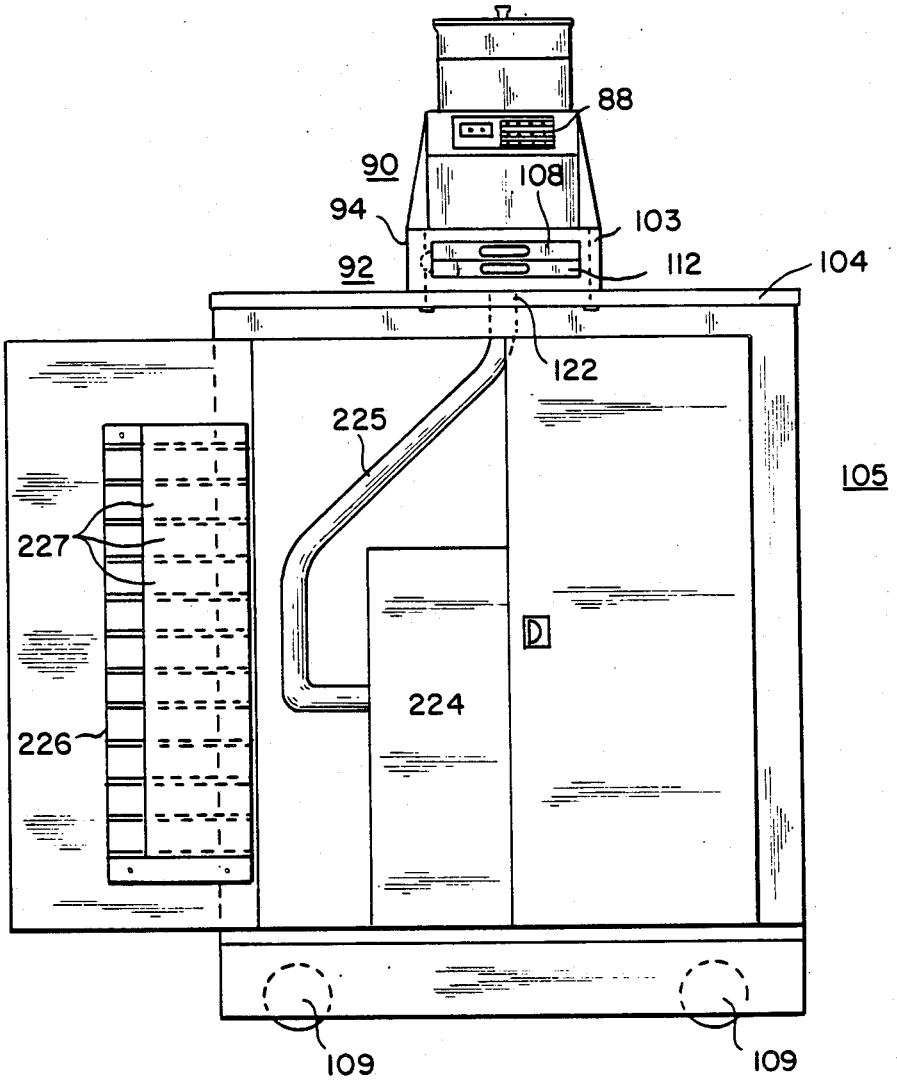

Referring now to FIG. 2, the improved sieving apparatus 90 of this invention is of diminutive size and is adapted to be supported on a counter 104, as for example of a cabinet 105 mounted on casters 109. Disposed within the cabinet 105 is an exhaust fan assembly 224 connected by a hose 225 to the improved sieving apparatus. Conveniently the cabinet 105 also includes a storage rack 226 or the like for a plurality of sieving screens 227 of varying standard character to provide an essentially self-contained analytic assembly.

Figure 3:
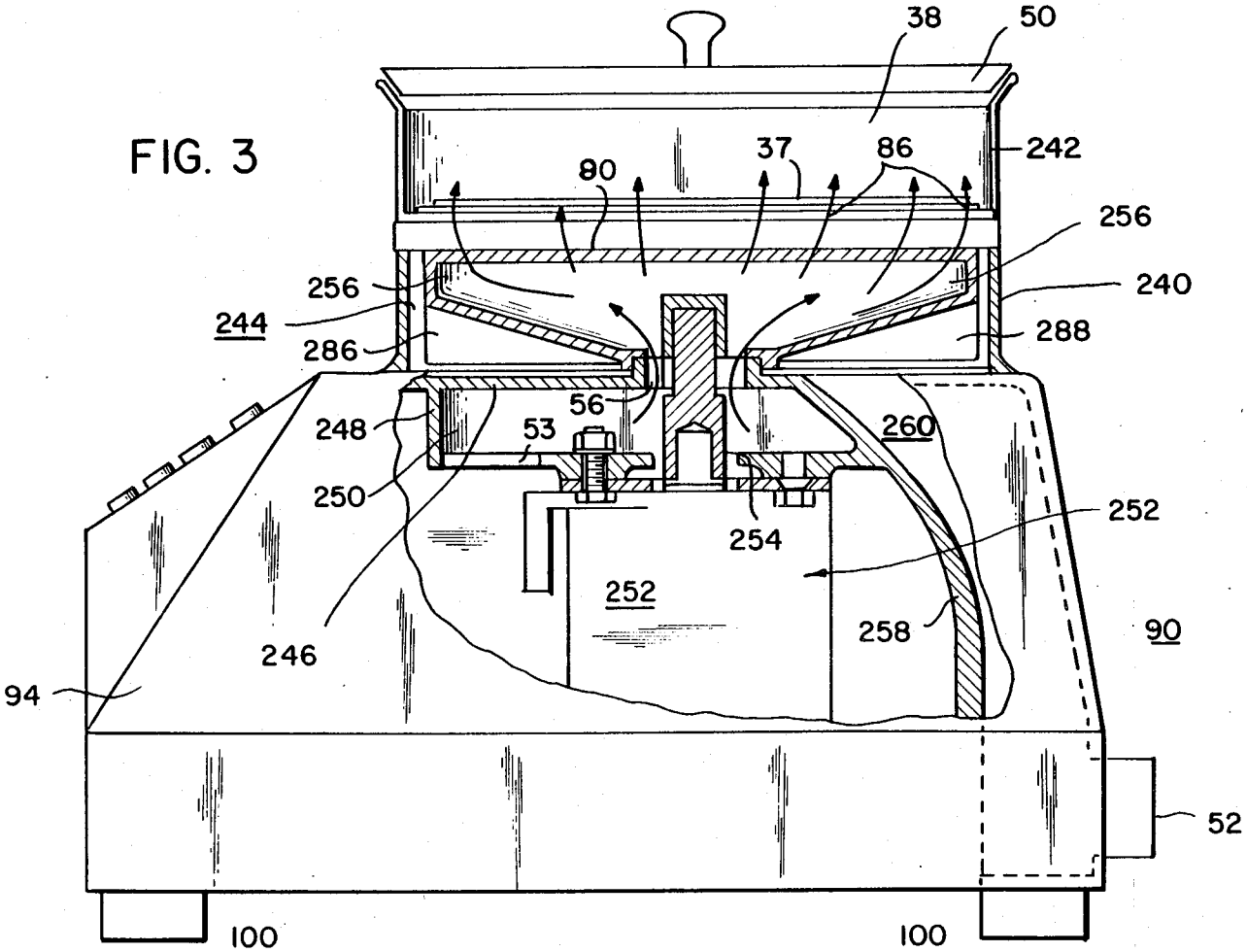
FIG. 3 is a side elevation, partially in section, of the improved sieving apparatus.
Figure 4:
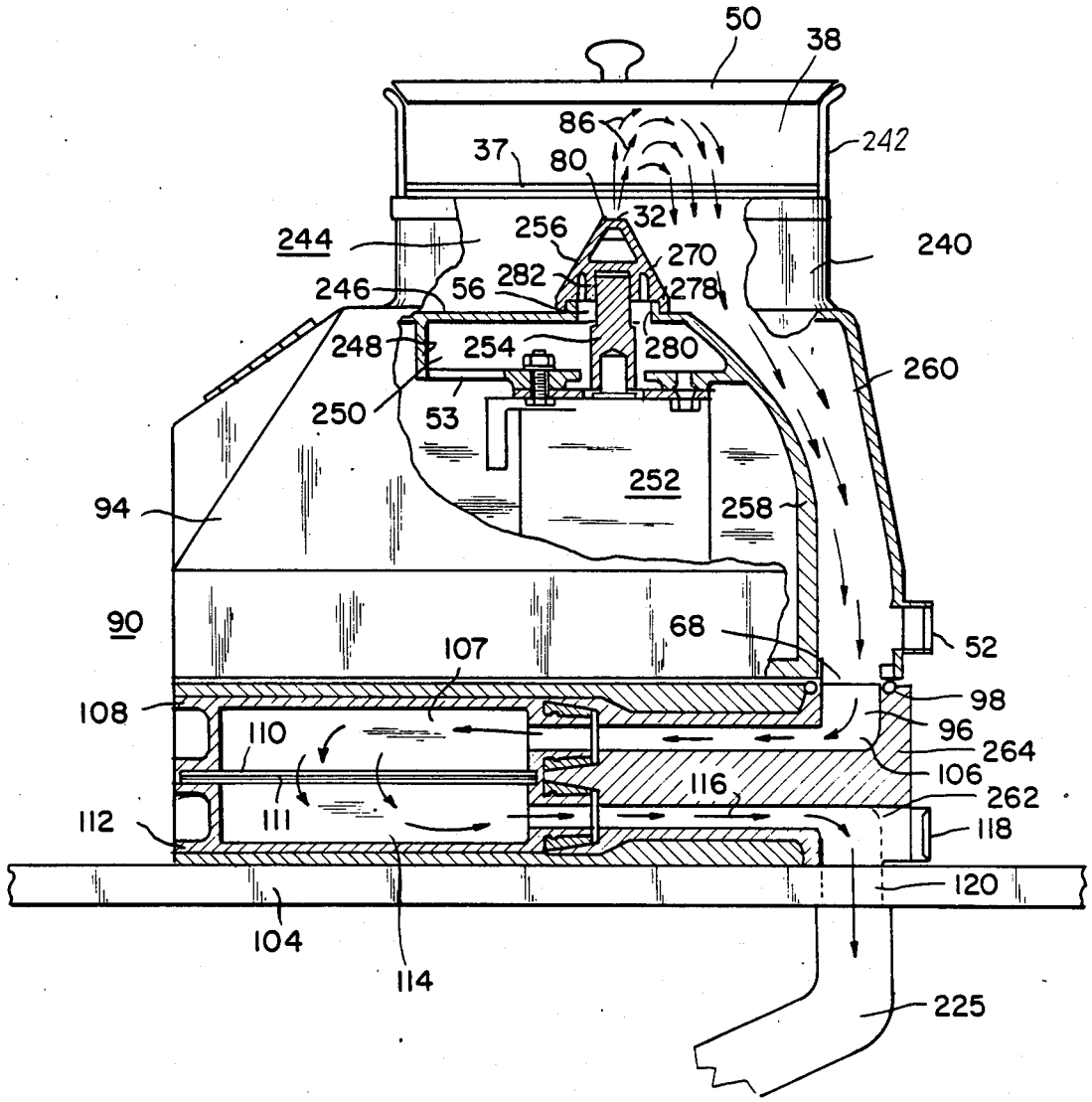
FIG. 4 is a side elevation, partially in section, of the improved sieving apparatus as shown in FIG. 3 but with the air jet curtain rotor displaced 90°.

As best depicted in FIGS. 3 and 4, such improved sieving apparatus 90 includes a generally rectangular base or housing section 94 having a plurality of feet 100 which may be removed if the unit is to be bolted atop particulate collection assembly 262. At its upper end the housing section 94 is selectively contoured to provide an upwardly open cylindrical section 240 adapted to seat a preselected sieving screen device 242 thereon and to serve as a fines collecting chamber, generally designated 244 immediately therebelow. The base of the fines collecting chamber 244 is formed by the upper surface 246 of a selectively contoured casting 248 which defines an inlet air plenum chamber 250 and a supporting mount for a motor 252. The motor 252 includes an extending drive shaft 254 on which is mounted the improved air jet curtain rotor 256 disposed within the fines collection chamber 244. The rear wall 258 of the casting 248 is spaced inwardly from the rear wall of the housing section 94 and cooperatively defines a fines delivery conduit 260 therebetween. As best shown in FIG. 4, such fines delivery conduit dependently communicates with a particulate collection assembly, generally designated 262, as described in detail at a later point in this specification.

As best shown in FIGS. 3 through 6, the improved device incorporates a selectively configured rotor element 256 of substantially diametric extant. Such rotor 256 is of a generally "C"-shaped configuration with the terminal ends thereof being disposed in a predetermined chordal spacing adjacent the screen periphery.

Figure 5:
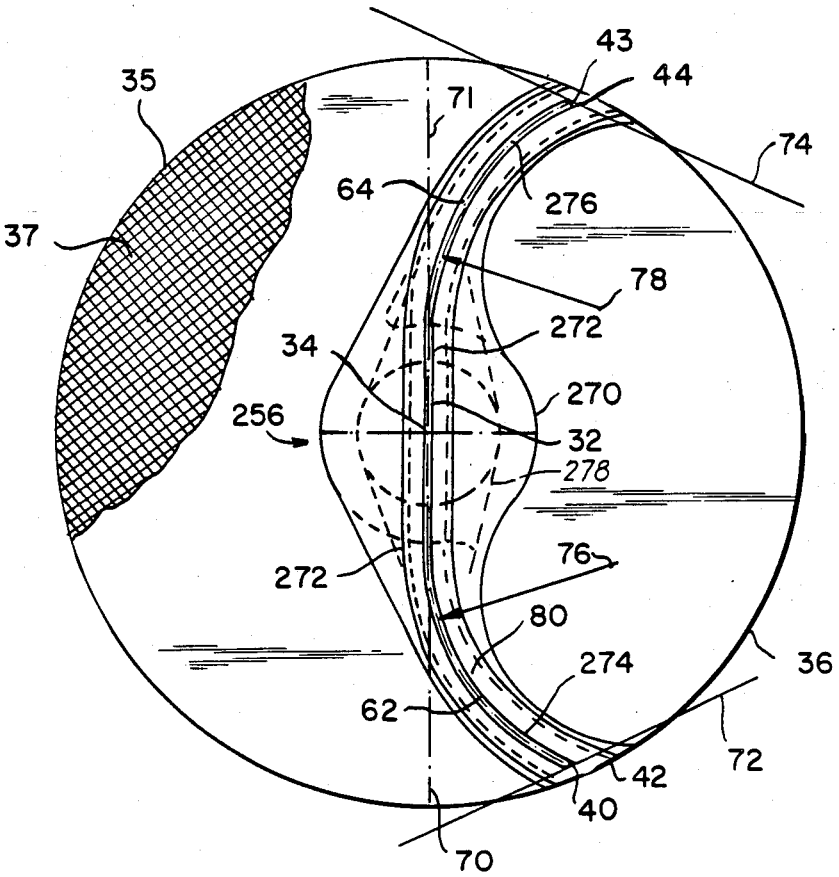
FIG. 5 is a plan view of the improved air jet curtain rotor, as viewed through a sieving screen.

In more particularity, and as best shown in FIG. 5, the rotor element 256 includes an enlarged hub portion 270 of generally circular configuration, a short outwardly directed and diametrically disposed center portion 272 disposed on either side of the hub portion and a pair of arcuately shaped end portions 274 and 276. The arcuate end portions 274 and 276 are of complemental configuration and are "bent" in the same direction with respect to the hub portion 270 to form said predetermined chordal space therebetween on the screen periphery as above pointed out.

Figure 6:
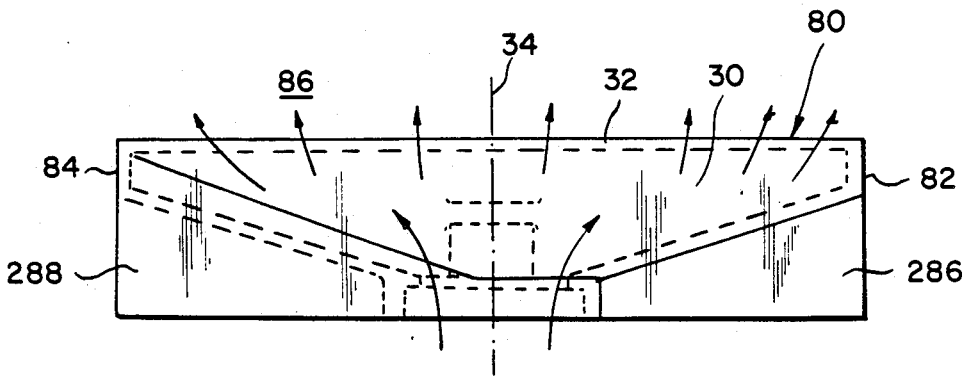
FIG. 6 is a side elevation of the air jet curtain rotor shown in FIG. 5.
Figure 7:
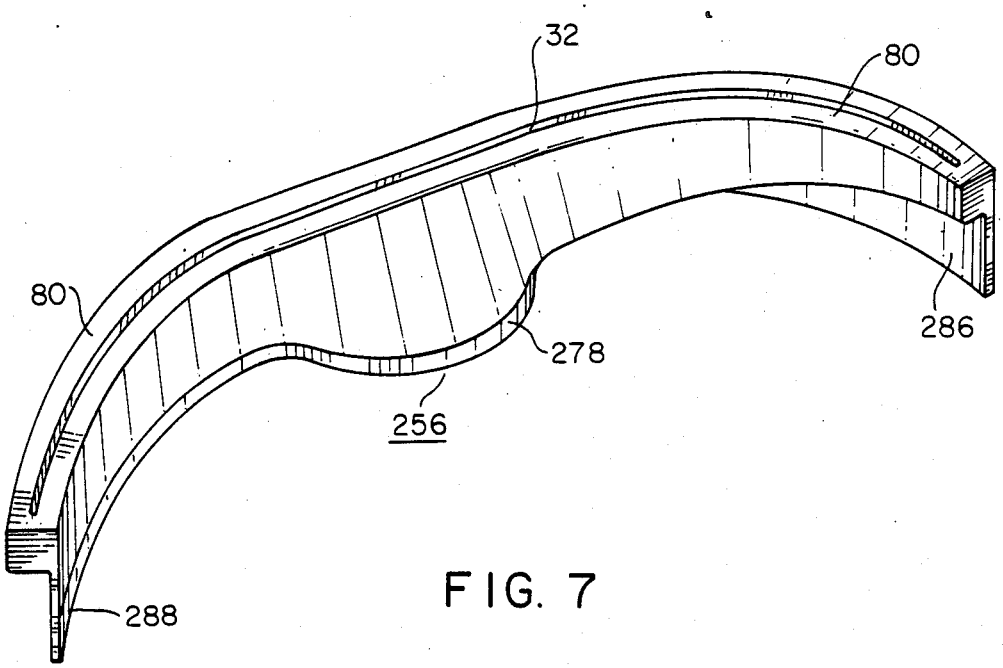
FIG. 7 is a perspective view of the air jet curtain rotor.
Figure 8:
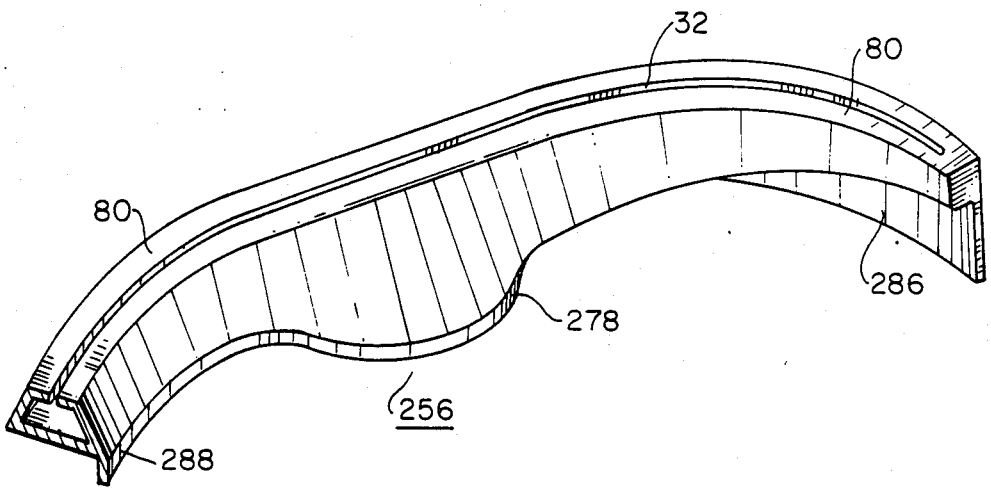
FIG. 8 is a perspective view of said rotor partially in section.

The rotor 256 is a hollow member of generally trapezoidal cross section with a flat upper surface 80 disposed in closely spaced relation with the undersurface of the screen 37. The center hub portion 270 includes a dependent hub 278 disposed in surrounding relation with a boss 280 on the upper surface 246 of the casting 248 together with a suitable socket 282 for mounting the rotor 256 on the shaft 254 of drive motor 252. As best shown in FIGS. 5 and 6, the cross section of the hollow interior portion thereof decreases in area as the radial distance from the hub increases in order to provide for a relatively uniform air from across and along the air jet curtain emitted from the slot 32 on the upper surface thereof.

As best shown in FIGS. 3, 5, 6, 7 and 8, the leading edge of the rotor on either side of the hub thereof includes a dependent skirt portion 286, 288 whose dependent edge is disposed in close proximity with the surface 246 forming the bottom of the fines collection chamber 244.

Included on the upper surface of the rotor 256 is an elongated slot 32 extending across the entire length of the rotor on either side of the axis of rotation 34 thereof. As shown, the rotor slot 32 comprises a pair of straight slot sections 62 and 64, each terminating in an arcuate end portion 40,43 respectively. The terminal ends of the arcuate end portions 40,43 are proximate to and preferably located closely below a point on the effective circular periphery 35 of the sieving screen 37 as shown in cutaway depiction in FIG. 5. Preferably, each terminal end of the slot 32 is, at any given instant and whether the rotor 256 is rotating or stationary, disposed proximate to or closely adjacent to the effective periphery 35 of the sieving screen 37. Such effective circumference or periphery of the screen 37 may be defined either as a line 35 on the screen disposed closely adjacent the circumferential wall of the sample chamber or as the circumference of the area swept by the gas jet curtain. In either case, such are substantially coincident.

As viewed in FIG. 5 and as previously described, the diametrically disposed center portions of the slot 32 outwardly merge into the curved portions 76 and 78 respectively. The curved portions 76 and 78 of the slot 32 may suitably comprise arcs of circles whose radii are both centered on the same side of the slot and to thereby form the aforesaid generally bowshaped configuration for both the rotor and the air jet curtain emitting slot 32.

In the operation of the disclosed apparatus, a preweighed quantity of dry powder is introduced into a sample chamber 38 through a removable cover 50 and deposited on the upper surface of the screen 37. Sieve screen 37 is suitably a standard screen with openings of predetermined size. In situations where fines recovery is not of concern, analysis is initiated by inducing a pressure drop at outlet connector 52 to create a pressure drop across the system. Air, or other gas, is introduced into the inlet plenum 250 through inlet vent 53, from whence it flows through a spidered annulus 56 surrounding drive shaft 254 into the interior of the hollow rotor 30. The air exits from said rotor 256 through the elongate narrow slot 32 in the upper surface 80 thereof in the form of a gas jet curtain generally designated 86 extending from one end 40 to the other 43 thereof of a configuration conforming to that of the slot 32 and being directed at the undersurface of sieving screen 37. The motor 60 drives rotor 256 in a counterclockwise direction as shown in FIG. 3. As the rotor rotates, the air jet curtain 86 impinges upon the underside of screen 37 and blows sample overlying powder clear of the screen openings and agitates and displaces the powder within the sample chamber 38. As previously pointed out, the curved shape of the end portions of the rotor arms 62 and 64 results in greater area of jet emission in an annulus near the periphery 36 of the screen to minimize powder accumulations at such location.

As best shown in FIG. 5, rotor arm 62 is curved so that the concave surface portion thereof operates as the leading edge thereof. Similarly, the shape of the air jet curtain conforms thereto. When this selectively shaped portion of air jet curtain impinges upon the screen supported powder, it tends to drive at least a portion of such powder inwardly towards the axis of rotation 34, with a consequent increase in the degree of agitation of said powder. Conversely, arcuate rotor arm 64 is curved so that the convex surface thereof serves as the leading edge and the shape of the air jet curtain emerging therefrom is also of convex configuration. When this selectively contoured portion of the air jet curtain impinges upon the screen supported powder, it tends to drive at least a portion of such powder outwardly toward the circumference of the sample chamber again furthering both the agitation and distribution of the powder within the sample chamber. Rotation of the rotor thus results in a reciprocatory type of displacement of the screen supported powder.

After each arm of rotor 256 passes beneath an area of sample chamber 38, the air and agitated powder suspended therein resumes the normal direction of flow through the screen and toward fines chamber 244 as shown in FIG. 4. Air and at least a portion of the fine particles of powder suspended therein will flow through the openings of sieve screen 37 and enter the fines chamber 244, with coarser particles lodging on the screen openings and tend to clog such openings, until they are again cleared by the action of the gas jet curtain emitted from the rotor 256. As the rotor 256 rotates, the above described process repeats itself many times until substantially all the fine particles have migrated through the screen 37, into fines chamber 244, down through outlet 260 and out through outlet connection 52. The flow of fines out of outlet 52 ends when substantially all of the fine particles have been removed from the sample. At that time the sample chamber 38 can be removed from its mated position atop the fines chamber 244 and the remaining coarse particles on the screen can be weighed to determine if they are of an amount within a tolerable specified limit.

The herein disclosed improved sieving apparatus further includes means to collect the separated fines as well as the retained coarse material. To this end, the sieving device 90 is adapted to include a filter assembly, generally designated 262, as shown in FIG. 4. Such filter assembly 262 comprises a housing 264 adapted to supportively mate with the above described components so that outlet 68 is disposed in sealed fluid communication with filter inlet 96, the junction between the two being sealed by O-ring 98 under the weight of the sieving device 90. From filter inlet 96, the fines laden effluent passes through duct 106 into an upper chamber 107. Chamber 107 is defined by upper filter body half 108 and bounded on its underside by a filter paper 110 or other appropriate filter media supported by filter screen 111. The screen 111 and filter paper 110 are located and secured by the clamping action of upper filter body half 108 and lower filter body half 112. Such filter screen 111 and lower filter body half 112 define a lower or downstream chamber 114. Filtered air is drawn into this downstream chamber 114 and passes through duct 116 to outlet port 118 or 120. Outlet connector 118 may be a standard vacuum cleaner connector adapted to mate with a vacuum cleaner hose and pass air through to the vacuum cleaner which provides the vacuum that drives the gas flow through this entire system. If the system is to be used in conjunction with cabinet 105, outlet connector 118 may be plugged and outlet port 120 may be opened on the underside of filter housing 264 to connect to hose 225 therein.

For convenience, the upper and lower filter body halves 108 and 112 are adapted to be slidably removable in drawer fashion from filter housing 264. They are joined together by their snug fit within filter housing 264 and once withdrawn simply come apart enabling fines to be easily collected from filter paper 110 and enabling replacement of said filter paper 110. After replacement of filter paper 110 the two halves 108 and 112 can be restacked one on top of the other and slid back into filter housing 264.

Having described our invention, we claim:

1. In a dry particulate sieving device of the type having a circular first chamber adapted to receive and contain particulate material having a range of particle sizes extending above and below a predetermined particle size;

a horizontally disposed planar screen serving as the floor of said first chamber and having a plurality of openings therein sized to pass particles having a size below said predetermined particle size therethrough;

a second circular chamber disposed below said first chamber adapted to receive particles passing through said screen; and a rotor assembly having a horizontally disposed upper surface positioned closely adjacent the undersurface of said planar screen adapted to direct an air jet curtain against the undersurface of and through said screen;

the improvement wherein the upper surface of said rotor assembly includes an elongate and generally C shaped slot having a substantially diametrically disposed center portion and a pair of arcuately bowed end portions disposed in facing relation and compositely traversing said screen undersurface for emitting a complementally C shaped jet curtain against the undersurface of said screen during rotation thereof.

2. A device according to claim 1 in which the terminal ends of said slot are disposed proximate to the effective periphery of said sieving screen.

3. A device according to claim 1 in which arcuately bowed end portions of said C shaped slot are arcs of circles whose radii are both centered same side of said rotor assembly.

* * * * *